United States Patent [19]

Rausing

[11] 3,935,968

[45] Feb. 3, 1976

[54] PACKING CONTAINER

[75] Inventor: Ruben A. Rausing, Rome, Italy

[73] Assignee: Tetra Pak Developpement SA, Lausanne, Switzerland

[22] Filed: June 14, 1974

[21] Appl. No.: 479,569

[30] Foreign Application Priority Data

June 20, 1973 Switzerland ..... 8960/73

[52] U.S. Cl. ..... 222/479; 215/356; 222/484

[51] Int. Cl.[2] ..... B67D 3/00; B65D 39/08

[58] Field of Search ..... 222/479, 478, 489, 488, 222/484, 485, 486; 229/14 B; 215/356

[56] References Cited

UNITED STATES PATENTS

| | | | |
|---|---|---|---|
| 959,012 | 5/1910 | Hinterman | 222/489 X |
| 2,785,839 | 3/1957 | DuPree | 222/479 |
| 3,330,450 | 7/1967 | Clare | 222/479 |
| 3,662,944 | 5/1972 | Joosten | 229/14 B |
| 3,666,163 | 5/1972 | Ignell | 229/14 B |
| 3,746,200 | 7/1973 | Flider | 222/479 |

*Primary Examiner*—Robert B. Reeves
*Assistant Examiner*—Hadd Lane
*Attorney, Agent, or Firm*—Pierce, Scheffler & Parker

[57] ABSTRACT

A composite container structure for fluent materials such as a liquid which is composed of an external cylindrical sleeve made from a relatively rigid material and an internal cylindric liner of plastic material for receiving the liquid. The internal liner terminates in a hemi-spherical bottom within the sleeve and the upper portion of the liner which projects beyond the sleeve has a dome-shaped configuration which terminates in a central inturned threaded neck forming a filling and pouring opening that is closed by an externally threaded plug portion of a screw type cap.

2 Claims, 5 Drawing Figures

PACKING CONTAINER

Figure 1:
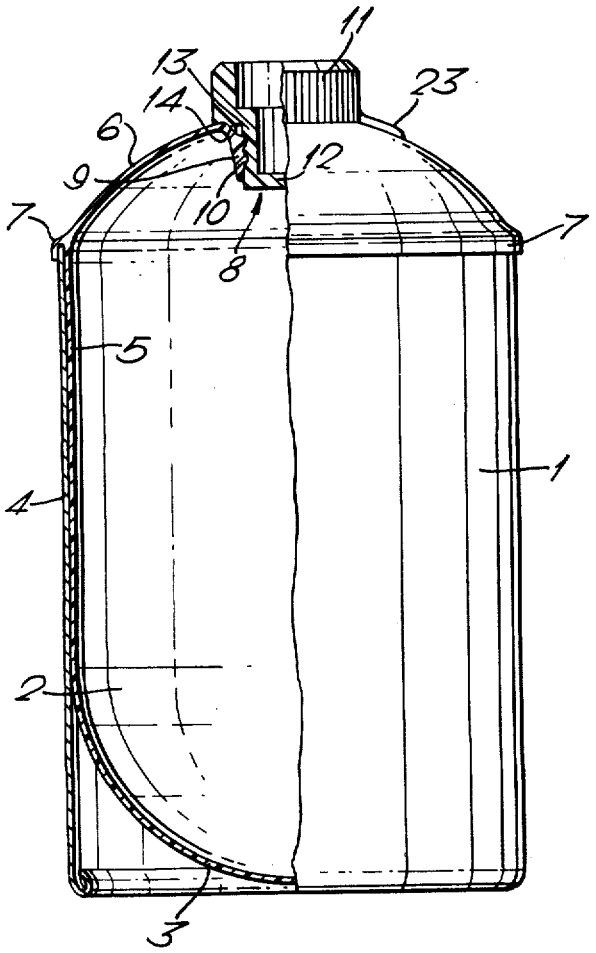

The present invention relates to a packing container for flowing or running fluid material, in particular fluid material under pressure, comprising on the one hand an inner lining of plastic material, which lining has a lower part with a cylindrical casing portion, whose one end is closed by a dished head, and an upper closing part, which is joined together with the said lower part, on the other hand an outer sleeve of a relatively rigid material, which sleeve is adapted so as to accomodate the lower part of the said lining and with a tight fit to join onto the casing portion of the lining, the said upper closing part being provided with a preferably centrally arranged filling and emptying hole, which is limited by a flange turned inwards belonging to the upper closing part, and that the emptying hole is designed so that it can be gas-tightly closed with the help of a cap part introduced into the emptying hole and/or covering the emptying hole.

Authorities and societies for the protection of the environment have raised more and more vigorously the demand that packing containers of glass and sheet-metal should be replaced by more ecologically acceptable material such as e.g. paper and other cellulose products and plastic material which can be burnt or, with the addition of chemical substances, made degradable.

Liquid materials of the type of beer, refreshing drinks and sparkling wines were packed previously mainly in packing containers of just glass or sheet-metal and the reason for this is that glass and sheetmetal have suitable strength and gas-tightness characteristics for the storage of pressurized liquids of the type of beer which contain a gas dissolved in the liquid, which in most cases is carbon dioxide ($CO_2$). Carbon dioxide gas is liberated from the liquid if the latter is not kept under pressure, and in order to be able to maintain such a pressure it is necessary that the packing container should have sufficient strength to be able to absorb the stresses emanating from the liquid material and that the packing container is so gas-tight, that no substantial drop in pressure can occur owing to gas leaking from the container.

Another group of fluid materials which has to be packed in tight, pressure-resistant containers is e.g. ground coffee, which together with a protective gas, in particular carbon dioxide, is accomodated in the container, with the gas having a pressure which exceeds the atmospheric pressure. It is the intention that by means of the protective gas it should be prevented that the packed product comes into contact with oxygen, which latter gas strongly impairs the taste of the product.

In recent times it has been found that packing containers made of plastic material can also be used for the packing of fluid material of the abovementioned type. If such packing containers are made wholly of plastic material, that is to say if the material of an ordinary bottle is changed from glass to plastic, e.g. polyvinyl chloride plastic, it is certainly possible to obtain a plastic bottle of satisfactory functioning, but such a bottle will be unrealistically costly to manufacture and, owing to the large mass of plastic, it is hardly ecologically acceptable. Another and better manner of solving the problem is to manufacture packing containers with an inner, thin-walled lining of plastic material, e.g. polyvinyl chloride or acrylonitrile compounds (e.g. of the acrylonitrile compound which comes into the trade under the brand name of BAREX). This inner, thin-walled lining has a cylindrical casing part which is supported mechanically by an outer sleeve of a rigid and only to a limited extent stretchable material, e.g. paper or cardboard. The end openings of the part of the casing which is mechanically supported are closed on the one hand by a lower dished, preferably hemispherical, head, on the other hand by an upper closing part which may be conical or dished. The inner plastic lining is dimensioned so that the hemispherical head and the upper closing part can withstand the pressure emanating from the fluid material without being substantially deformed, whilst the cylindrical casing part, in which owing to known physical laws the stresses are greater than in the rest of the parts, must be supported by the outer sleeve so that the casing part should not be deformed.

The plastic material in these packing containers is degraded when it is exposed to solar radiation, but it is also possible to add to it, in a known manner, a chemical material, e.g. a benzophenone, which absorbs ultraviolet light radiation and which contributes to a more rapid degradation or biological destruction of the plastic material when the same is disposed of in nature and is exposed to solar radiation.

The abovementioned ecologically acceptable plastic packages have the disadvantage, however, that the caps or closing stoppers that are used for closing the emptying and filling openings present relatively great gas leakage, since it is difficult to achieve fully satisfactory contact between the cap and the emptying opening of the packing container. If the upper end closing part in the said packages is made too low in relation to the remainder of the package, that is to say if the package is provided with a relatively plane upper end wall and is thus given a drum-like character, the so-called plopping phenomenon arises when the liquid material is to be poured out, since the air cannot at the same time penetrate into the container and occupy the space represented by the amount of liquid material poured out. Since the liquid material is pressurized a relatively thick and expensive material is required in order to prevent a deformation of the package and to hinder such a deformation the upper, non-supported end surface of the package must be formed with such a convexity that the stresses in the material causing deformation are not too great.

Certain known packing containers of the abovementioned type are provided with an emptying opening which is surrounded by a flange directed outwards which is integral with the remainder of the end closure part, which flange is provided with a male screw thread which is adapted to the female screw thread of a closing cap. Screw closures of this type have the disadvantage, however, that they project relatively far from the surface of the upper end closure part, which entails inconveniences from the point of view of storage and of handling. For this reason it is advantageous if in cap devices of the screw type, instead the upper closing part is provided with a flange directed inwards, provided with female screw thread which defines the emptying opening of the package, which emptying opening can be closed by a stopper-like cap provided with screw thread, which need only have such a height above the surface of the upper closing part that a comfortable and safe finger grip can be applied around the handling part of the cap.

A package which in accordance with the invention is provided with a flange turned inwards around the emptying opening is difficult to empty completely according to experience, since the flange directed inwards forms a pocket around the emptying opening. The presence of the flange directed inwards also tends to increase the propensity for plopping of the package, since the flange directed inwards forms a barrier wall which prevents the air from getting into the packing container when the latter is inclined in connection with the emptying of the container.

The abovementioned inconveniences are overcome by a packing container in accordance with the invention, which is characterized in that the said flange turned inwards is provided with a number of holes perforating the flange which are located around the circumference of the flange in preferably uniform spacing.

In the following will be described some suitable embodiments of the invention with reference to the enclosed schematic drawing, in which FIG. 1 shows a partly sectional side view of a packing container in accordance with the invention.

Figure 2:
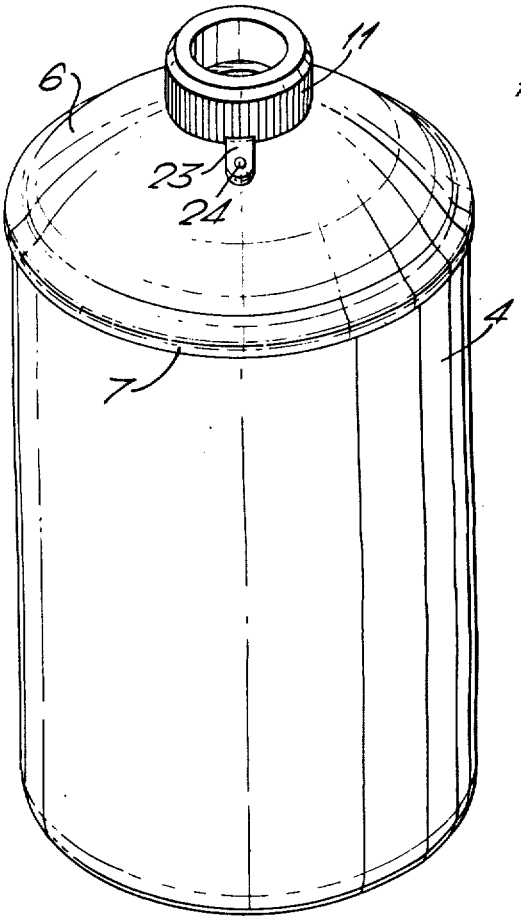

FIG. 2 shows a perspective view of a finished package, and

FIGS. 3*a*, *b*, and *c* show different realizations of the emptying opening and its closing part.

In the partly sectional packing container shown in FIG. 1 the lower part of the plastic lining of the container is designated 2 and the upper closing part is designated 6. The lower part of the plastic lining consists of, on the one hand, a circular cylindrical casing part 5, on the other hand a dished head 3, and the lower part of the lining is joined to the upper closing part 6 along a connecting flange 7. The casing part 5 of the plastic lining is surrounded, with a tight fit, by an outer sleeve 4 around the upper edge of which the said flange 7 is bent over, and the sleeve 4 is of such a length that its lower edge extends past the said dished head of the lining 2.

In the upper closing part 6 is provided an emptying opening 8 through which opening the liquid material intended for the package is also to be introduced in connection with the filling of the package. The emptying opening 8 is surrounded by a flange 9 turned inwards and joined to the upper closing part 6, whose inside can be provided with a screw thread 10. After the filling of the packing container, the emptying hole 8 is closed by means of a stopper-like cap 11, whose part 13 projecting into the emptying opening is provided with a male screw thread, which is matched with the screw thread 10 of the inwards turned flange 9. To achieve sufficient tightening between the cap 11 and the upper closing part 6 the cap 11 is provided with a sealing tongue 14, which, when the cap 11 is screwed into the opening, will be pressed against a seat in the upper part of the emptying opening with the intention of obtaining a gas-tight closure.

The construction of the emptying opening and different variations thereof will be described in more detail in connection with the description of FIG. 3.

In FIG. 2 is shown a perspective view of the packing container in accordance with the invention, and for the sake of clarity the same reference numbers have been used for the same parts which are shown in FIG. 1. The upper closing part 6 may be designed as a weakly dished head, but it can also be in the form of a hemisphere or as a cone of greater or lesser height. There is thus a considerable amount of freedom regarding the shape of the upper closing part, likewise of course the shape of the cap 11. However, the internal pressure prevailing in the package has to be taken into account in the dimensioning of the upper closing part 6 as well as of the cap 11.

Figure 3:
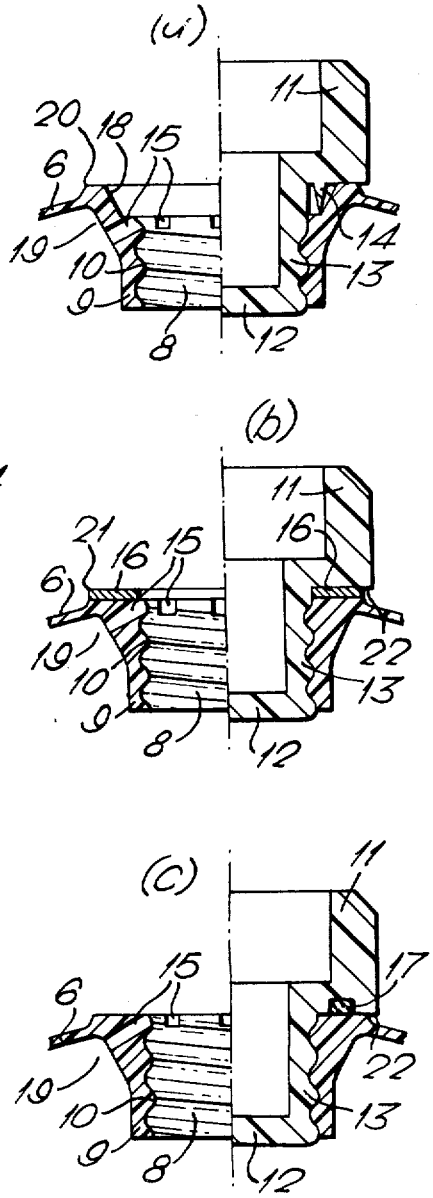

In FIG. 3 are shown three different embodiments of the closing device of the packing container, but it is common to all three closing devices that the upper closing part 6 is provided with a flange 9 turned inwards and that the said flange 9 turned inwards is provided with a screw thread 10. Furthermore, it is common to all three versions that the emptying opening is intended to be closed by means of a stopper-like cap part 11, the part 13 of which for introduction into the emptying opening is provided with a male screw thread which can co-operate with screw thread 10 of the flange 9 turned inwards.

As mentioned earlier, the emptying openings with a flange turned inwards have the inconvenience that a portion of the liquid contents remains behind in the pocket 19 which is formed when the packing container is inclined in connection with the pouring out of the liquid material, and likewise the propensity for plopping of the packing container is increased since the flange turned inwards acts as a screen which prevents air from penetrating into the interior of the packing container and replacing the liquid material emptied out. As can be seen from FIG. 2 the versions of the emptying opening shown are provided with holes or ducts 15 which are arranged in the flange 9 turned inwards within the upper part of the emptying opening. The said holes or ducts 15 are arranged in uniform spacing around the emptying opening 8. In addition to it being made possible for the liquid material collected in the pocket 19 mentioned earlier to flow out through the ducts 15 in conjunction with the emptying of the packing container, air can pass in through the ducts 15, which means that the packing container during emptying can be inclined appreciably more than in the case where no ducts 15 are arranged in the flange 9 turned inwards, without any risk of plopping.

It is a pre-condition for the functioning of the closing device that the cap can close the emptying opening 8 tightly without there being any risk of the gas enclosed in the packing container under pressure leaking out, and this sealing can be achieved in a number of different ways.

In FIG. 3*a* is shown a closing device where the mouth of the emptying opening 8 has a seat 18 running around the mouth, which in the case shown consists of a conical surface. The mouth also has a relatively square cut-off pouring edge 20, over which the liquid material pouring out is allowed to flow. The holes 15 mentioned earlier through the flange 9 turned inwards are located under the sealing seat 18 of the mouth and are distributed with preferably uniform spacing around the mouth. After the filling of the packing container, which if the material is beer has to take place at low temperature to avoid frothing, the cap 11 is screwed in by fitting the threads in the cap part 13 against the threads 10 in the flange 9 turned inwards. The cap 11 is provided with a sealing tongue 14 which preferably has a triangular cross-section and extends around the cap as an annular ridge. When the cap 11 is screwed in into the emptying opening 8 the sealing tongue 14 will be pressed against the seat 18, with the front part of the sealing tongue being deformed so that a good seal is achieved between the sealing tongue 14 and the seat 18. The gas, which may be able to penetrate through the threads of the cap 11 and the flange 9 turned inwards, will be effectively barred by the sealing tongue 14, and the pressure of the gas helps to achieve an even greater sealing effect, since the pressure thrusts the sealing tongue 14 harder against the conical seat 18.

When the packing container is to be opened, the cap is screwed off, whereby the pressure in the container is gradually equalized and it is so possible to avoid the violently explosive drop in pressure which occurs at the opening of beer bottles and refreshing drink bottles with known cap closures. As mentioned earlier, the packing container is emptied in known manner in that it is inclined towards the horizontal plane, when the liquid material will flow out through the emptying opening 8. Owing to the fact that the pouring opening ends in a square cut-off pouring edge 20, it is prevented that the liquid material might run along the upper end closing part 6 of the paccking container, but the jet of liquid material leaves the packing container at the pouring edge 20. The said pouring edge 20 was covered during the transport and handling of the packing container by the cap 11, so that no dust or dirt was able to accumulate along the pouring surface. Owing to the presence of the holes 15 in the flange 9 turned inwards air can penetrate into the packing container and replace the liquid material poured out although the packing container is inclined more than would be possible if there had been no holes present without a risk of plopping. As mentioned earlier, all the liquid material can moreover be emptied from the package. Since the liquid material which is collected in the pocket 19 when the package is turned up and down runs off through the holes 15. If the packing container is not completely emptied it can easily be re-closed with the help of the cap 11.

The closing device in accordance with FIG. 3*b* operates in the same way as the closing part shown in FIG. 3*a*, but with the difference that the sealing tongue 14 is replaced by a soft sealing washer 16, which is likewise provided with a relatively square cut-off pouring edge 21. The sealing washer 16 can be glued or welded to the upper closing part 6 around the emptying hole 8, and the sealing effect between the sealing washer 16 and the sealing surface 22 of the cap directed towards the sealing washer is accomplished in the manner described above in that the cap 11 is screwed into the pouring opening 8, the flange 9 turned inwards being provided with a female screw thread 10. The pouring opening in accordance with FIG. 3*b* is provided in the manner described above with holes 15 penetrating the flange 9 around the emptying opening and the filling and emptying of the packing container is done in the manner as described in connection with FIG. 3*a*.

In FIG. 3*c* is shown a variant of the sealing device in accordance with FIG. 3*b*. The sealing washer 16 in FIG. 3*b* has been substituted in FIG. 3*c* by a sealing ring 17, which is fitted into a groove in the cap 11. The sealing ring 17 may be a so-called O-ring, that is to say a sealing ring with circular cross-section, or else the sealing ring may also consist of sealing compound which is inserted into the said groove provided in the cap 11. In the manner described earlier sealing between the cap 11 and the upper closing part 6 of the packing container is achieved through that the cap 11 is screwed into the pouring opening 8, the flange 9 of which directed inwards is provided with a thread 10 which is matched to the screw thread of the cap 11.

To guarantee to the consumer who buys the package that the package has not been opened after the filling operation, it is appropriate to provide the cap 11 with some kind of seal, which may consist of a banderol over the cap 11 or else a plastic lug 23 attached to the cap, which in the manner as shown in FIG. 2 is heat-sealed along an easily breakable sealing area 24 against the upper closing part 6 of the packing container. This is only one example as to how the sealing of the cap 11 may be solved, and there must be a large number of other equivalent manners for sealing the cap against the packing container in such a manner that the cap cannot be screwed off without any special sign thereof becoming unrecognizable.

The packing container is manufactured appropriately in a manner known in itself by deep-drawing of plastic material, e.g. PVC or BAREX, whereupon the deep-drawn parts are joined together along the sealing flange 7 and the plastic lining is joined to the outer sleeve 4. This can be done in known automatic packing machines in a rational manner and with a high capacity. The emptying hole in the packages, which are manufactured in the said automatic machines, is accomplished in that a circular blank is punched out of the upper closing part, which blank has to be disposed of as waste. In the present case, where the flange turned inwards is to be provided with screw threads it is necessary to accumulate relatively much material on the flange 9 turned inwards, since the latter, in view of the screw closure, has to have a relatively high mechanical stability. Instead of punching out the circular blank which is intended to form the emptying hole, the plastic material is redistributed through plastic deformation in warm condition, so that the quantity of plastic which has to be removed so as to form the emptying hole 8 in the upper closing part 6 is removed and redistributed to the flange 9 turned inwards so as to form the screw thread 10, which is manufactured by means of press moulding before the plastic material has become stablilized through cooling. The cap 11 may be manufactured of the same plastic material as the plastic lining, and for the manufacture of the cap 11 the unavoidable waste may be used which is produced when the lower and upper part, 2 and 6 respectively, of the plastic lining are deep-drawn from heated circular portions of a web.

In case the packing container is intended to be used for powdered contents, e.g. ground coffee, the emptying hole has to be made large enough for the contents to be readily poured out or taken out of the package with the help of e.g. a spoon, and in most cases it will be necessary to make the emptying hole so large that it occupies the greater part of the dished head.

I claim:

1. A packing container for liquids comprising a container composed of plastic material and provided with a convex upper portion forming a dome and an inwardly turned flange element surrounding a pouring opening in the top of the convex upper portion, and a cap member releasably secured in the pouring opening for closing said container, said cap member having an outwardly and radially extending offset portion for sealingly engaging the rim of the pouring opening at the top of the convex upper portion when said cap member is secured in the pouring opening, the improvement wherein said inwardly turned flange element is provided with a plurality of spaced passages arranged circumferentially around and extending through the upper portion of the inwardly turned flange element from the upper portion of the pouring opening radially inwardly of the rim thereof and downwardly and radially outwardly into the top portion of the container adjacent the top of the dome formed by the convex upper portion whereby when the cap member is removed and the container is tilted for pouring the liquid contents therefrom, the uppermost passages permit the entrance of air into the container to permit even flow of the liquid from the container and the lowermost passages permit flow of liquid from the container into the liquid passing through the pouring opening and so that residual liquid which would normally be trapped in the convex upper portion when the container is almost empty will drain outwardly therethrough.

2. A packing container as claimed in claim 1 and further comprising sealing means cooperating with the offset portion of said cap member for sealingly engaging the rim of the pouring opening.

* * * * *